US012714263B2

(12) United States Patent
Champagne et al.

(10) Patent No.: US 12,714,263 B2
(45) Date of Patent: Aug. 25, 2026

(54) SOLID CORE BATHROOM FIXTURES AND METHODS THEREOF

(71) Applicant: MAAX Bath Inc.

(72) Inventors: Jean Sébastien Champagne, La Prairie (CA); Marc-Yvan Meilert, Lachine (CA); Jonathan Thibault, Honfleur (CA); Dominic Dion, LaSalle (CA)

(73) Assignee: Maax Bath Inc., Lachine (CA)

( * ) Notice: Subject to any disclaimer, the term of this patent is extended or adjusted under 35 U.S.C. 154(b) by 323 days.

(21) Appl. No.: 18/489,659

(22) Filed: Oct. 18, 2023

(65) Prior Publication Data

US 2025/0127342 A1 Apr. 24, 2025

(51) Int. Cl.
*A47K 3/40* (2006.01)
*A47K 3/02* (2006.01)

(52) U.S. Cl.
CPC . *A47K 3/40* (2013.01); *A47K 3/02* (2013.01)

(58) Field of Classification Search
CPC ..... A47K 3/02; A47K 3/40
USPC ..... 4/584
See application file for complete search history.

(56) References Cited

U.S. PATENT DOCUMENTS 4,543,366 A 9/1985 Smith
4,680,214 A 7/1987 Frisch et al.
4,695,509 A 9/1987 Cordova et al.
4,770,926 A 9/1988 Yamamura et al.
4,784,904 A 11/1988 Wood et al.
4,983,433 A 1/1991 Shirasaki
5,009,950 A 4/1991 Wagner et al.
5,874,133 A 2/1999 Cochran
5,891,560 A 4/1999 Edwards et al.
6,030,907 A 2/2000 Ito et al.
6,156,403 A 12/2000 Cochran
6,388,010 B1 5/2002 St. Clair
6,521,298 B1 2/2003 Banks
6,617,032 B2 9/2003 Rickner et al.
6,656,858 B1 12/2003 Cahill
6,699,916 B2 3/2004 Lekovic et al.
6,726,957 B2 4/2004 Niemiec
6,730,382 B2 5/2004 Fanucci et al.
6,824,860 B2 11/2004 Edwards et al.
6,861,128 B1 3/2005 Müller et al.
6,863,973 B2 3/2005 Tomokuni et al.
2008/0098511 A1* 5/2008 Sisk ..... B29C 70/086 4/584

(Continued)

*Primary Examiner* — Lauren A Crane
(74) *Attorney, Agent, or Firm* — Bradley Arant Boult Cummings LLP; Phillip E. Walker; Alex H. Huffstutter

(57) ABSTRACT

A solid core bath apparatus or fixture may include an exterior shell, an inner core positioned within a hollow inner portion of the exterior shell, and an adhesive coating coupled between the inner core and the inner surface of the exterior shell. The exterior shell may include a protective outer surface and an inner surface defining the hollow inner portion. A central portion of the protective outer surface may generally be sloped towards a shell drain opening defined between the protective outer surface and the inner surface. The inner core may include at least one planar outer surface configured to be supported by a support surface when the bath apparatus is installed. The inner core in conjunction with the adhesive coating may prevent or reduce any deflection of the exterior shell when stood upon.

20 Claims, 8 Drawing Sheets

(56) References Cited

U.S. PATENT DOCUMENTS

2012/0066830 A1* 3/2012 Kim ..... B29C 44/06
4/584

* cited by examiner

SOLID CORE BATHROOM FIXTURES AND METHODS THEREOF

A portion of the disclosure of this patent document contains material that is subject to copyright protection. The copyright owner has no objection to the reproduction of the patent document or the patent disclosure, as it appears in the U.S. Patent and Trademark Office patent file or records, but otherwise reserves all copyright rights whatsoever.

BACKGROUND

1. Field of the Invention

The present disclosure relates generally to bathroom fixtures such as sinks, bathtubs, shower stalls, shower drain pans, shower or bath wall coverings, and the like. More particularly, the present disclosure pertains to solid core polymer reinforced bathroom fixtures.

2. Description of the Prior Art

Acrylic, Acrylonitrile Butadiene Styrene (ABS), and/or fiberglass are popular materials used to manufacture bathroom fixtures such as sinks, bathtubs, shower stalls, shower drain pans, shower or bath wall coverings, and the like. Acrylic, ABS, and/or fiberglass bathroom fixtures are durable, making them less prone to chipping or cracking compared to more brittle materials. Due to the non-porous nature, these fixtures generally resist staining and are relatively easy to clean. Acrylic, ABS, and/or fiberglass fixtures are generally hollow and lightweight, making them easier to handle and install compared to heavier materials. Finally, Acrylic, ABS, and/or fiberglass bathroom fixtures are affordable.

Acrylic, ABS, and/or fiberglass bathroom fixtures, while having many benefits, are prone to deflection, which refers to the bending or flexing of the material under pressure. This can occur if heavy objects are placed on the fixture or if someone leans or applies excessive force on a specific area. The material's deflection may be worsened due to the hollow design of many bathroom fixtures. Material deflection can lead to the development of cracks or structural damage over time.

Solutions to the deflection issue may include increasing the thickness of the material and including reinforcement materials such as glass fibers. These solutions, however, negatively impact the affordability of the products may increasing manufacturers production costs.

Alternative materials, such as cast iron still include hollow interior but do not have any deflection issues. This material type, however, is much more expensive and extremely heavy.

BRIEF SUMMARY

In view of at least some of the above-referenced problems in conventional Acrylic, ABS, and/or fiberglass bathroom fixtures implementations, an exemplary object of the present disclosure may be to provide an improved solid core reinforced bathroom fixture apparatus and method thereof is provided herein.

An exemplary such apparatus may include an exterior shell which includes a hollow inner portion similar to typical bathroom fixtures discussed above. An exemplary such apparatus may desirably feature an inner core (e.g., a molded foam block) configured to fill a majority of the hollow inner portion of the exterior shell. The exemplary such apparatus may feature a gap between the inner core and the exterior shell. The exemplary such apparatus may further feature a polymer reinforcement layer configured to adhere the inner core to the exterior shell, fill the gap, and fill any remaining hollow areas within the hollow inner portion of the exterior shell. The polymer reinforcement layer of the exemplary such apparatus may further include a hardener configured to reinforce the exterior shell when cured. The exemplary such apparatus may feature a drain reinforcement member positioned between the exterior shell and the inner core. The drain reinforcement member may strength the exterior shell proximate a drain opening and also seal the drain opening from the polymer reinforcement layer.

In a particular embodiment, an exemplary bath apparatus as disclosed herein may include an exterior shell, an inner core, and an adhesive coating defined between the exterior shell and the inner core. The exterior shell may include a protective outer surface and an inner surface defining a hollow inner portion. A central portion of the protective outer surface may generally be sloped towards a shell drain opening defined between the protective outer surface and the inner surface. The inner core may be positioned within the hollow inner portion of the exterior shell and may include at least one planar outer surface configured to be supported by an external support surface when the bath apparatus is installed.

In an exemplary aspect according to the above-referenced embodiment, the inner core includes a core drain opening aligned with the shell drain opening.

In another exemplary aspect according to the above-referenced embodiment, the bath apparatus may further comprise a drain reinforcement member including an upper flange, a reinforcement opening defined through the upper flange, and a downward extending rim surrounding the reinforcement opening and extending from the upper flange. The upper flange may be configured to engage the inner surface of the exterior shell surrounding the shell drain opening. The downward extending rim may be configured to be received by the core drain opening.

In another exemplary aspect according to the above-referenced embodiment, the inner surface of the exterior shell may include a downward protrusion surrounding the shell drain opening. The upper flange of the drain reinforcement member may include a channel surrounding the reinforcement opening. The channel may be shaped to receive the downward protrusion of the exterior shell.

In another exemplary aspect according to the above-referenced embodiment, the drain reinforcement member may further include a plurality of triangular reinforcements positioned between the upper flange and the downward extending rim.

In another exemplary aspect according to the above-referenced embodiment, the plurality of triangular reinforcements may be positioned between the downward extending rim and the reinforcement opening.

In another exemplary aspect according to the above-referenced embodiment, a diameter of the upper flange may be greater than twice that of the reinforcement opening.

In another exemplary aspect according to the above-referenced embodiment, a gap may be defined between the inner surface of the exterior shell and the inner core. The gap may include a plurality of gap distances defined perpendicular to the inner core.

In another exemplary aspect according to the above-referenced embodiment, the adhesive coating may be configured to fill the gap.

In another exemplary aspect according to the above-referenced embodiment, each of the plurality of gap distances may be less than or equal to a predetermined maximum gap distance.

In another exemplary aspect according to the above-referenced embodiment, the predetermined maximum gap distance may be less than or equal to 1 inch.

In another exemplary aspect according to the above-referenced embodiment, the gap may be greater than zero.

In another exemplary aspect according to the above-referenced embodiment, the gap decreases near one or more edges of the exterior shell. The one or more edges may be configured to engage the support surface when the bath apparatus is installed.

In another exemplary aspect according to the above-referenced embodiment, the gap may be substantially similar over a majority of the inner surface of the exterior shell.

In another exemplary aspect according to the above-referenced embodiment, the adhesive coating may form a continuous layer between the inner core and the inner surface of the exterior shell.

In another exemplary aspect according to the above-referenced embodiment, the adhesive coating may comprise polyurethane-based material.

In another exemplary aspect according to the above-referenced embodiment, the polyurethane-based material may include an expanding agent and hardener.

In another exemplary aspect according to the above-referenced embodiment, the exterior shell may have a consistent thickness of about 0.08 inch.

In another exemplary aspect according to the above-referenced embodiment, the exterior shell may have a thickness less than or equal to 0.1 inch.

In another exemplary aspect according to the above-referenced embodiment, the inner core may comprise a solid foam material. The solid foam material may have a density of between about 2.0 pounds per cubic foot and about 2.8 pounds per cubic foot.

In another exemplary aspect according to the above-referenced embodiment, a deflection of the bath apparatus relative to the exterior shell may be less than or equal to 0.05 inch.

In another embodiment, an exemplary method of assembling a bath apparatus as disclosed herein may include the steps of: (a) depositing an expanding adhesive material onto an inner surface of an exterior shell of the bath apparatus; (b) engaging a foam core of the bath apparatus with the expanding adhesive material to cause the expanding adhesive material to fill a gap defined between the foam core and the inner surface of the exterior shell; and (c) maintaining a position and pressure on the foam core relative to the exterior shell until the expanding adhesive material stops expanding and begins to cure.

DETAILED DESCRIPTION

Reference will now be made in detail to embodiments of the present disclosure, one or more drawings of which are set forth herein. Each drawing is provided by way of explanation of the present disclosure and is not a limitation. In fact, it will be apparent to those skilled in the art that various modifications and variations can be made to the teachings of the present disclosure without departing from the scope of the disclosure. For instance, features illustrated or described as part of one embodiment can be used with another embodiment to yield a still further embodiment.

Thus, it is intended that the present disclosure covers such modifications and variations as come within the scope of the appended claims and their equivalents. Other objects, features, and aspects of the present disclosure are disclosed in, or are obvious from, the following detailed description. It is to be understood by one of ordinary skill in the art that the present discussion is a description of exemplary embodiments only and is not intended as limiting the broader aspects of the present disclosure.

The words "connected", "attached", "joined", "mounted", "fastened", and the like should be interpreted to mean any manner of joining two objects including, but not limited to, the use of any fasteners such as screws, nuts and bolts, bolts, pin and clevis, and the like allowing for a stationary, translatable, or pivotable relationship; welding of any kind such as traditional MIG welding, TIG welding, friction welding, brazing, soldering, ultrasonic welding, torch welding, inductive welding, and the like; using any resin, glue, epoxy, and the like; being integrally formed as a single part together; any mechanical fit such as a friction fit, interference fit, slidable fit, rotatable fit, pivotable fit, and the like; any combination thereof; and the like.

Unless specifically stated otherwise, any part of the apparatus of the present disclosure may be made of any appropriate or suitable material including, but not limited to, metal, alloy, polymer, polymer mixture, wood, composite, or any combination thereof.

Figure 1:
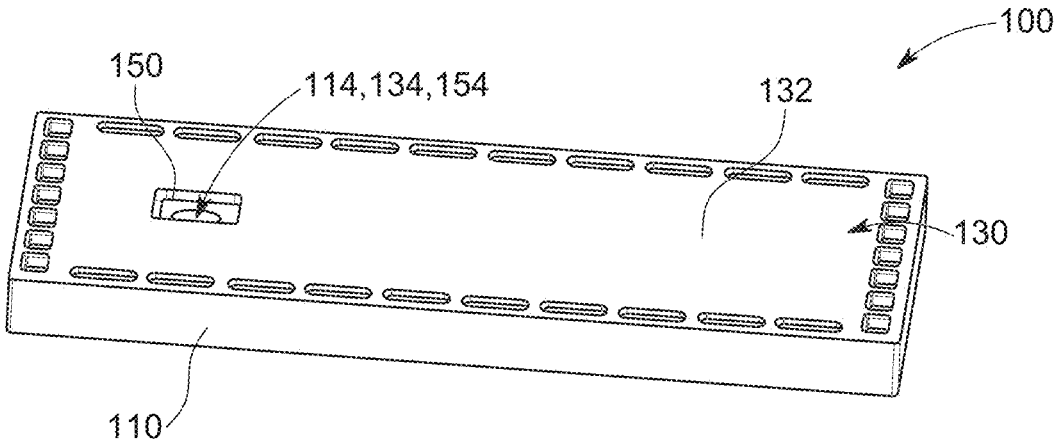
FIG. 1 is a lower perspective view of a bath apparatus in the form of a shower drain pan in accordance with the present disclosure.
Figure 2:
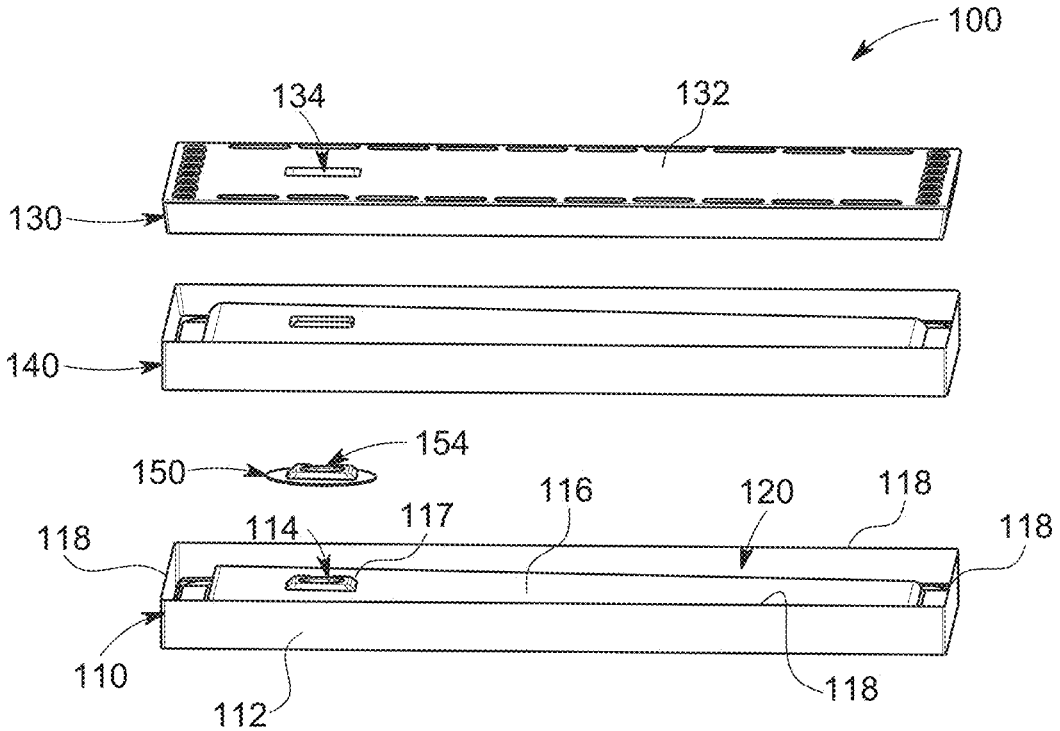
FIG. 2 is an exploded lower perspective view of the bath apparatus of FIG. 1 in accordance with the present disclosure.
Figure 3:
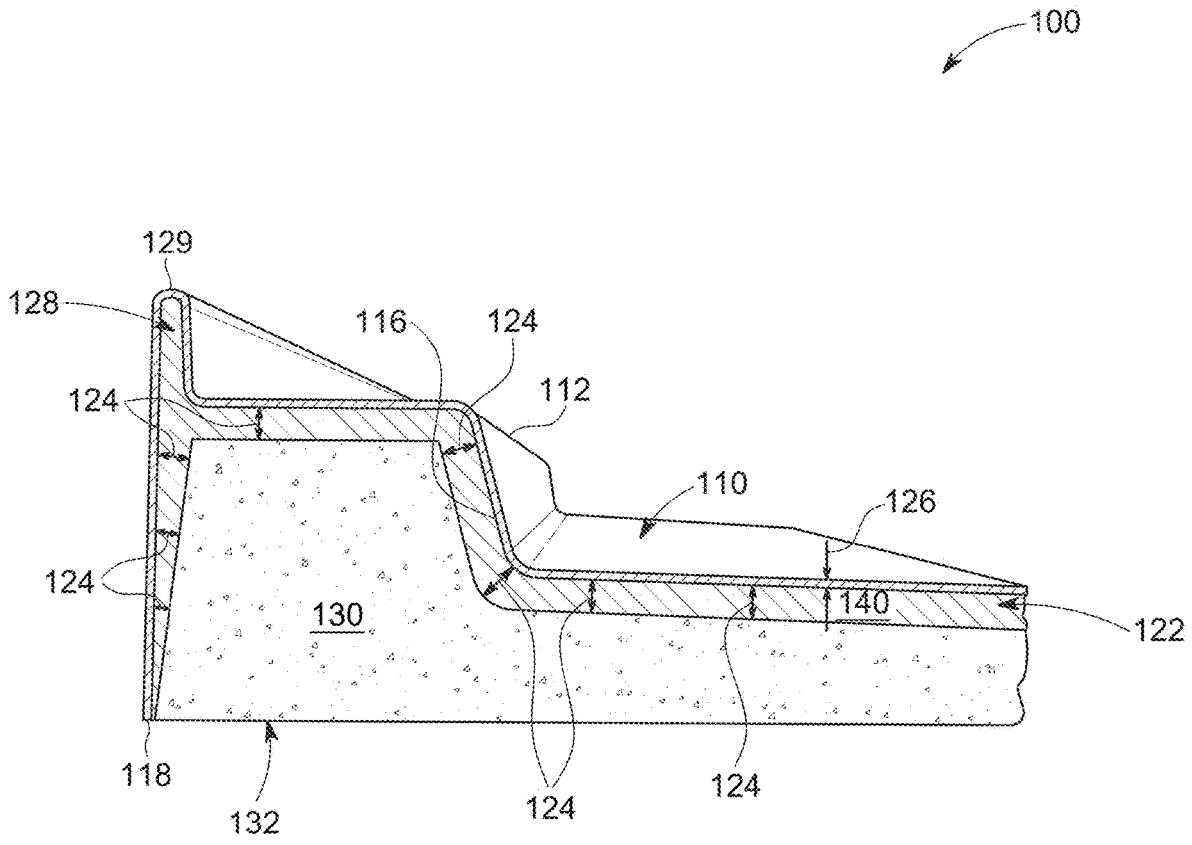
FIG. 3 is an enlarged cross-sectional view of the bath apparatus of FIG. 1 taken along line 3-3 of FIG. 1 in accordance with the present disclosure.

Referring to FIGS. 1-3, an embodiment of a bath apparatus 100 in accordance with the present disclosure is illustrated. The bath apparatus 100 may also be referred to herein as a solid core bathroom fixture 100. The bath apparatus 100 may be a sink, a bathtub, a complete shower stall, a shower drain pan, shower or bath wall coverings, or the like. The bath apparatus 100 may include an exterior shell 110, an inner core 130, and an adhesive coating 140. The inner core 130 may also be referred to herein as a foam core 130. The adhesive coating 140 may also be referred to herein as a polymer reinforcement layer 140. In certain optional embodiments, the bath apparatus 100 may include a drain reinforcement member 150. The drain reinforcement member 150 may be positioned between the exterior shell 110 and the inner core 130.

Figure 4:
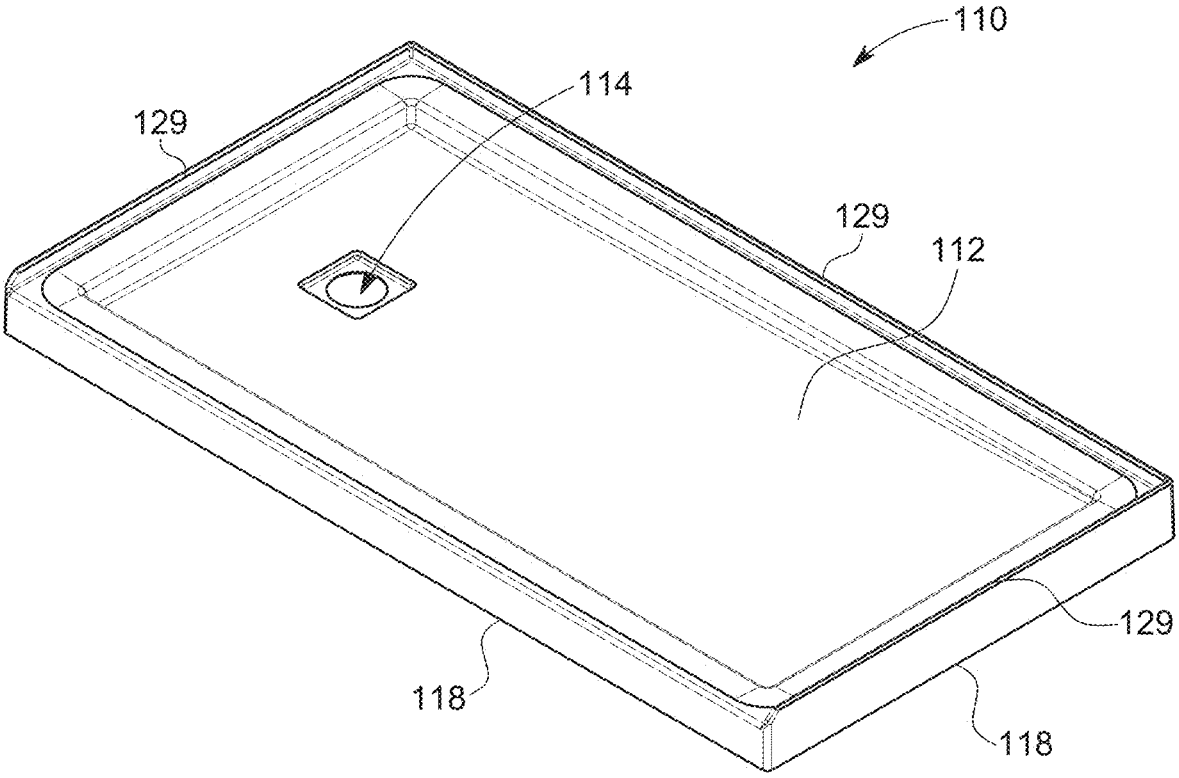
FIG. 4 is an upper perspective view of an embodiment of an exterior shell of the bath apparatus of FIG. 1 in accordance with the present disclosure.
Figure 5:
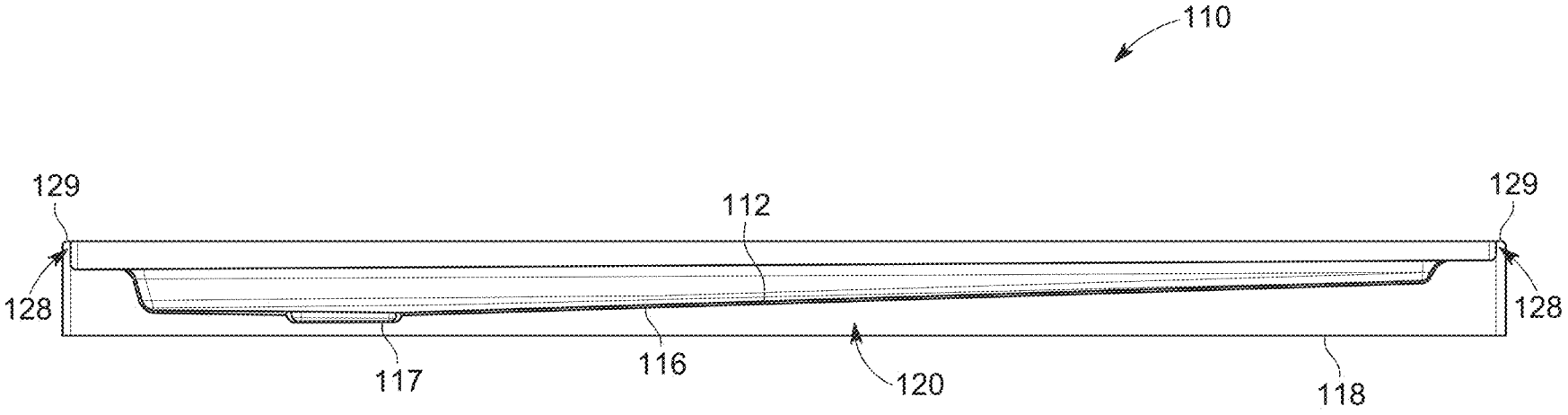
FIG. 5 is a cross-sectional view of the exterior shell of FIG. 4 taken along line 5-5 of FIG. 4 in accordance with the present disclosure.

The exterior shell 110 may define a protective outer surface 112 which is generally the surface that receives and interacts with water from a plumping fixture and/or a user of the bath apparatus 100. As illustrated in FIGS. 4-5, a central portion of the protective outer surface 112 may be generally sloped towards a shell drain opening 114. The exterior shell 110 may include an inner surface 116. The exterior shell 110 may include a hollow inner portion 120 defined at least in part by the inner surface 116. The hollow inner portion 120 may further be defined, at least in part, by at least one rim 118 of the exterior shell 110. The at least one rim 118 may also be referred to herein as one or more edges 118. The at least one rim 118 may be configured to engage a support surface, such as, for example, a floor surface, a wall surface, or ceiling surface (not illustrated). The exterior shell 110 may be formed from an acrylic material, an Acrylonitrile Butadiene Styrene (ABS) material, or the like. In certain optional embodiments, the exterior shell 110 may have a thickness 126 of about 0.08 inch. In other optional embodiments, the thickness 126 may be less than or equal to 0.1 inch. Material costs associated with the exterior shell 110 may decrease as the thickness 126 is decreased. Deflection of the bath apparatus 100 relative to the exterior shell 110 may be less than or equal to 0.05 inch.

Figure 6:
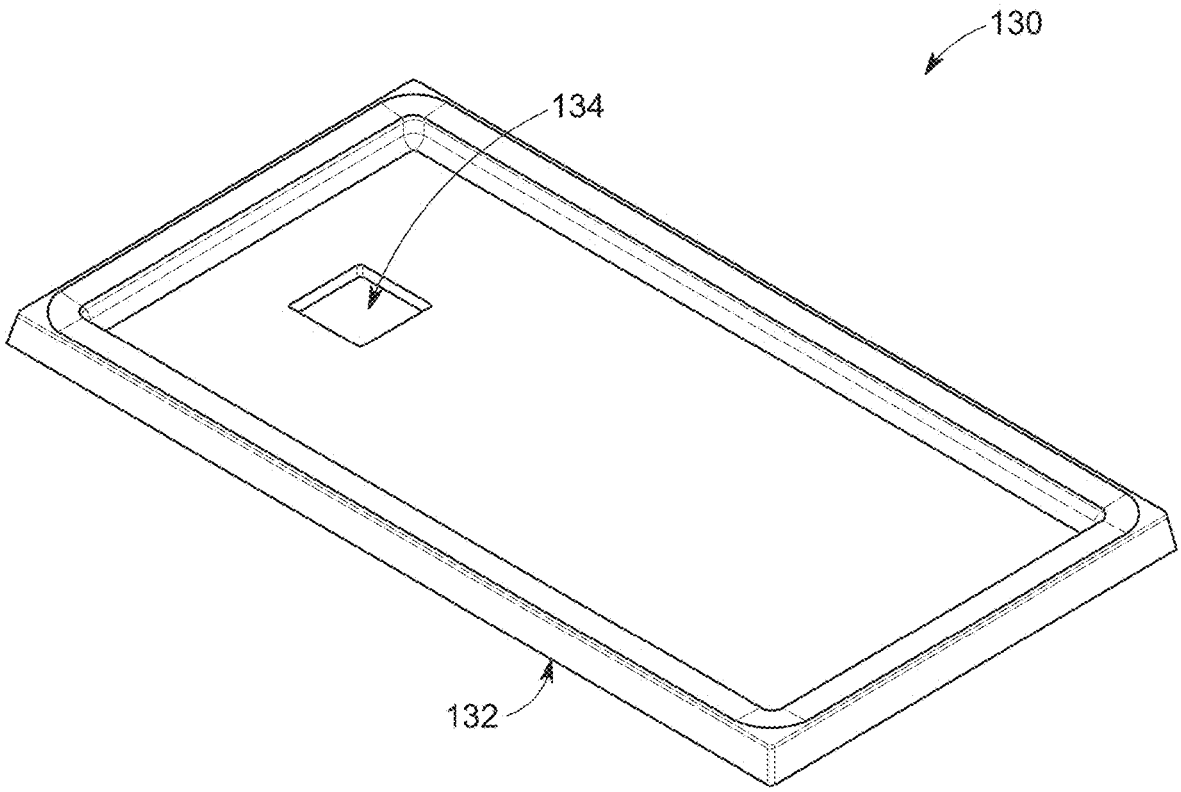
FIG. 6 is an upper perspective view of an embodiment of an inner core of the bath apparatus of FIG. 1 in accordance with the present disclosure.

The inner core 130 may be positioned within the hollow inner portion 120 of the exterior shell 110 and may be configured to help prevent deflection of the exterior shell 110. Additional details of the inner core 130 are illustrated in FIG. 6. The inner core 130 may include at least one planar outer surface 132. The at least one planar outer surface 132 may be flush with the at least one rim 118. As such, the at least one planar outer surface 132 may be supported by one or more of a floor surface, a wall surface, or ceiling surface where the bath apparatus 100 may be installed. The inner core 130 may further include a core drain opening 134 aligned with the shell drain opening 114. The inner core 130 may be formed from a solid foam material, such as expanded polystyrene (EPS) foam or like lightweight material. For example, the inner core 130 may be a molded EPS foam produced by molding expanded polystyrene beads into specific shapes or forms using steam and pressure. The inner core 130 (e.g., solid foam material) may have a density between about 2.0 pounds per cubic foot and about 2.8 pounds per cubic foot. In certain embodiments, the density may be about 2.4 pounds per cubic foot.

As illustrated in FIG. 3, a gap 122 may be defined between the inner surface 116 of the exterior shell 110 and the inner core 130. In certain optional embodiments, the inner core 130 may partially contact the inner surface 116 of the exterior shell 110, however, as illustrated, the inner core 130 is fully gapped from the inner surface 116 of the exterior shell 110 (e.g., the gap 122 is greater than zero). In certain optional embodiments, the gap 122 may include one or more gap distances 124 defined perpendicular to the inner core 130, for example when the gap 122 is consistent. In other optional embodiments, the one or more gap distances 124 may also be referred to herein as a plurality of gap distances 124, for example, when the gap 122 varies.

In certain optional embodiments, each of the plurality of gap distances 124 may be less than or equal to a predetermined maximum gap distance. The predetermined maximum gap distances may be less than or equal to 1 inch. In certain optional embodiments, the predetermined maximum gap distances may be less than or equal to 0.9 inch. In other optional embodiments, the predetermined maximum gap distances may be less than or equal to 0.8 inch. In further optional embodiments, the predetermined maximum gap distances may be less than or equal to 0.7 inch. In further optional embodiments, the predetermined maximum gap distances may be less than or equal to 0.6 inch. In further optional embodiments, the predetermined maximum gap distances may be less than or equal to 0.5 inch. In further optional embodiments, the predetermined maximum gap distances may be less than or equal to 0.4 inch. In further optional embodiments, the predetermined maximum gap distances may be less than or equal to 0.3 inch. In further optional embodiments, the predetermined maximum gap distances may be less than or equal to 0.2 inch. In further optional embodiments, the predetermined maximum gap distances may be less than or equal to 0.1 inch.

In certain optional embodiments, the inner surface 116 of the exterior shell 110 may include additional channels such as an upper channel 128 configured to define an upper rim 129 in the protective outer surface 112. In certain optional embodiments, the upper channel 128 may have a width less than or equal to the predetermined maximum gap distance. The gap distances associated with the upper channel 128 may be larger than the predetermined maximum gap distance. As such, a majority of the plurality of gap distances 124 may be less than or equal to the predetermined maximum gap distance. In other optional embodiments, over 60% of the plurality of gap distances 124 may be less than or equal to the predetermined maximum gap distance. In further optional embodiments, over 70% of the plurality of gap distances 124 may be less than or equal to the predetermined maximum gap distance. In additional optional embodiments, over 80% of the plurality of gap distances 124 may be less than or equal to the predetermined maximum gap distance. In still further optional embodiments, over 90% of the plurality of gap distances 124 may be less than or equal to the predetermined maximum gap distance.

In some optional embodiments, the gap 122 may be substantially similar over a majority of the inner surface 116 of the exterior shell 110. In other optional embodiments, the gap 122 may be consistent over 75% of the inner surface 116 of the exterior shell 110. In further optional embodiments, the gap 122 may be consistent over 80% of the inner surface 116 of the exterior shell 110. In certain optional embodiments, the gap 122 may be consistent over 85% of the inner surface 116 of the exterior shell 110. In other optional embodiments, the gap 122 may be consistent over 90% of the inner surface 116 of the exterior shell 110. In further optional embodiments, the gap 122 may be consistent over 95% of the inner surface 116 of the exterior shell 110.

In certain optional embodiments, the gap 122 may decrease as you approach the at least one rim 118 of the exterior shell 110. This may decrease a size of the opening between the inner core 130 and the exterior shell 110 for reducing the amount of adhesive coating which may escape when the inner core 130 is inserted into the hollow inner portion 120 of the exterior shell 110. This may further help to apply pressure to the adhesive coating 140 to thereby cause it to fill any other gaps, channels, or the like prior to escaping the opening between the inner core 130 and the exterior shell 110.

The adhesive coating 140 may be configured to couple the inner core 130 and the exterior shell 110, specifically the inner surface 116 of the exterior shell 110, together. The adhesive coating 140 may be configured to completely fill the gap 122. The adhesive coating 140 may form a continuous layer between the inner surface 116 of the exterior shell 110 or the inner core 130. In certain optional embodiments, the adhesive coating 140 may be sprayed, poured, or extruded (e.g., cylindrically like a bead) onto one of the inner surface 116 of the exterior shell 110 or the inner core 130. Ideally, the adhesive coating 140 is disposed on the inner surface 116 of the exterior shell 110 prior to insertion of the inner core 130 into the hollow inner portion 120 of the exterior shell 110.

The adhesive coating 140 may be a polyurethane-based material. The polyurethane-based material may be specifically formulated to expand once applied (e.g., include an expanding agent), for example, to fill in the gap 122. This expansion may be due to the presence of a blowing agent in the formulation, which reacts and releases gas bubbles as the adhesive cures. The expansion helps to fill gaps and voids between the bonded surfaces, improving adhesion strength and providing a more uniform bond line. The polyurethane-based material may further include a hardener in its formulation (e.g., a hardening agent), which results in the formation of cross-linked polymer chains as the material cures leading to the hardening and solidification of the adhesive coating 140. As such, the adhesive coating 140 is supported by the inner core 130, which may be supported by a support surface, and further supports the exterior shell 110.

Figure 7:
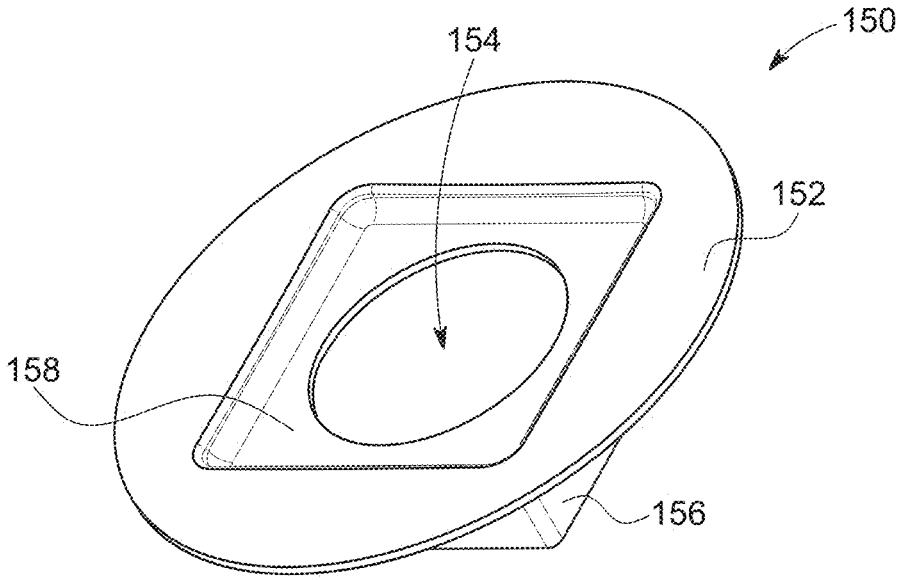
FIG. 7 is an upper perspective view of an embodiment of a reinforced drain member of the bath apparatus of FIG. 1 in accordance with the present disclosure.
Figure 8:
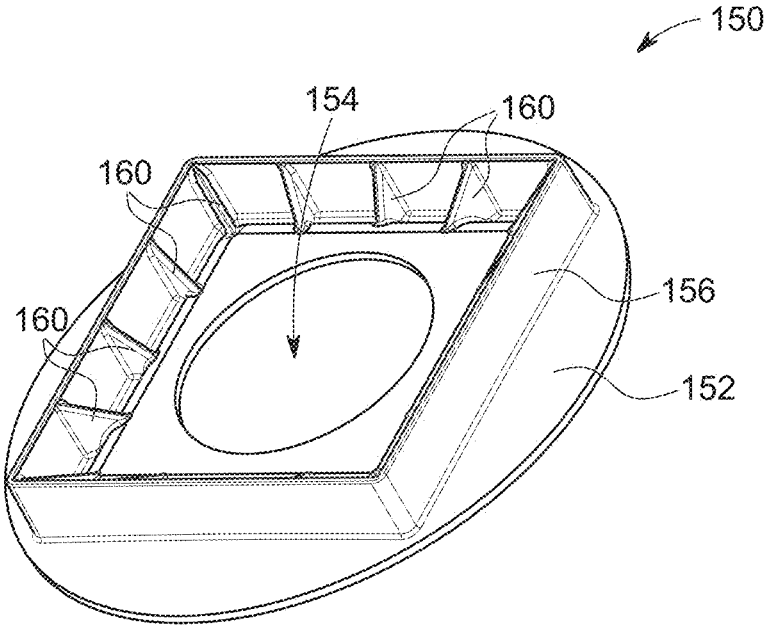
FIG. 8 is a lower perspective view of the reinforced drain member of FIG. 7 in accordance with the present disclosure.
Figure 9:
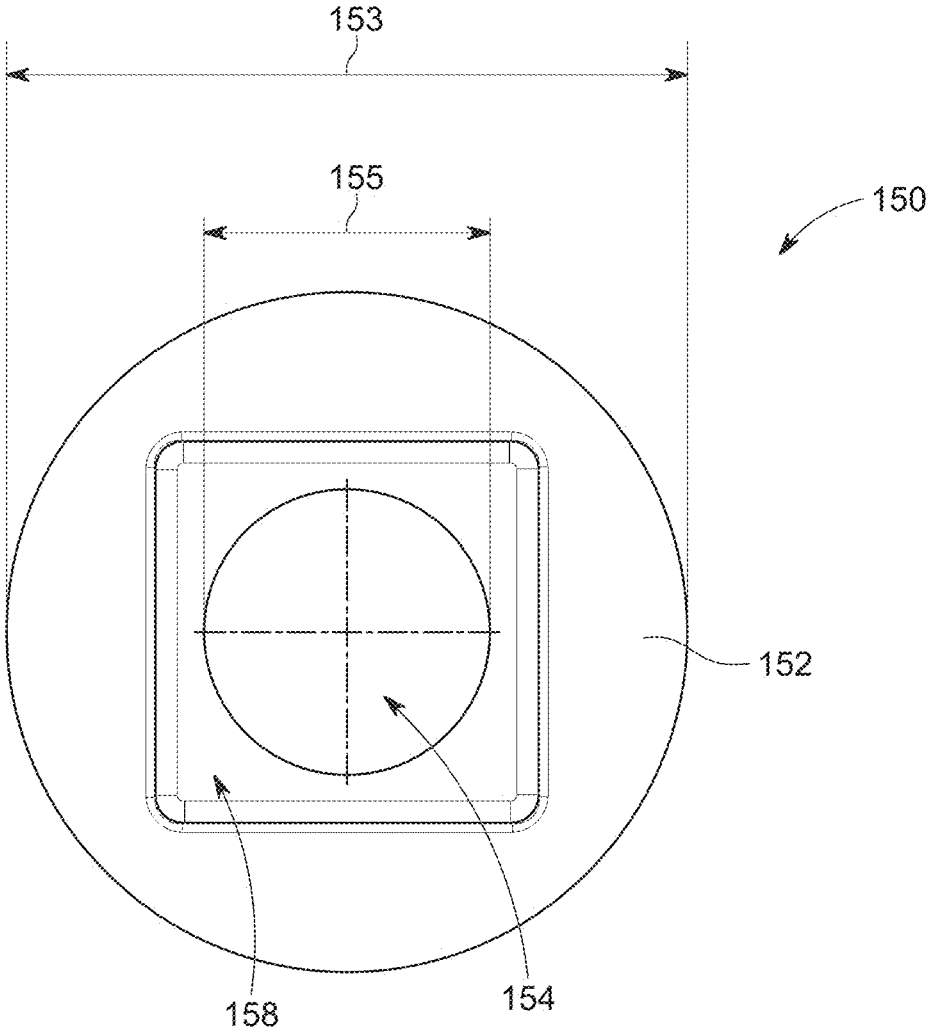
FIG. 9 is a top plan view of the reinforced drain member of FIG. 7 in accordance with the present disclosure.

As illustrated in FIGS. 7-9, the drain reinforcement member 150 may include an upper flange 152, a reinforcement opening 154 defined through the upper flange 152, and a downward extending rim 156 surrounding the reinforcement opening 154 and extending from the upper flange 152. The upper flange 152 may be configured to engage the inner surface 116 of the exterior shell 110 surrounding the shell drain opening 114. The downward extending rim 156 may be configured to be received by the core drain opening 134 of the inner core 130. In certain optional embodiments, the upper flange 152 may be circular. In other optional embodiments, the upper flange 152 may be some other shape, such as, for example, square or the like. As illustrated in FIG. 9, a diameter 153 of the upper flange 152 may be more than twice a diameter 155 of the reinforcement opening 154.

In certain optional embodiments, the inner surface 116 of the exterior shell 110 may include a downward extending portion 117 surrounding the shell drain opening 114. The downward extending portion 117 of the inner surface 116 may also be referred to herein as a downward extension 117 or a downward protrusion 117. The upper flange 152 of the drain reinforcement member 150 may further include a channel 158 surrounding the reinforcement opening 154. The channel 158 may be shaped to receive the downward extending portion 117 of the inner surface 116 of the exterior shell 110. In certain optional embodiments, each of the channel 158 and the downward extending portion 117 may be square shaped. In other optional embodiments, each of the channel 158 and the downward extending portion 117 may be circular, or some other shape. The interaction between the channel 158 and the downward extending portion 117 may prevent any of the adhesive coating 140 from seeping into the openings as it expands and cures. In certain optional embodiments, an adhesive or sealant may be applied between the upper flange 152 of the drain reinforcement member 150 and the inner surface 116 of the exterior shell 110.

The drain reinforcement member 150 may further include a plurality of triangular reinforcements 160 coupled between the upper flange 152 and the downward extending rim 156. In certain optional embodiments, the plurality of triangular reinforcements 160 may be positioned between the reinforcement opening 154 and the downward extending rim 156. As such, the plurality of triangular reinforcements 160 may be out of the way from interfering with the downward extending rim 156 being inserted into the core drain opening 134. Each of the downward extending rim 156 and the core drain opening 134 may be shaped and sized similarly such that the downward extending rim 156 is snugly received by the core drain opening 134 to prevent any of the adhesive coating 140 from seeping into the openings as it expands and cures.

Figure 10:
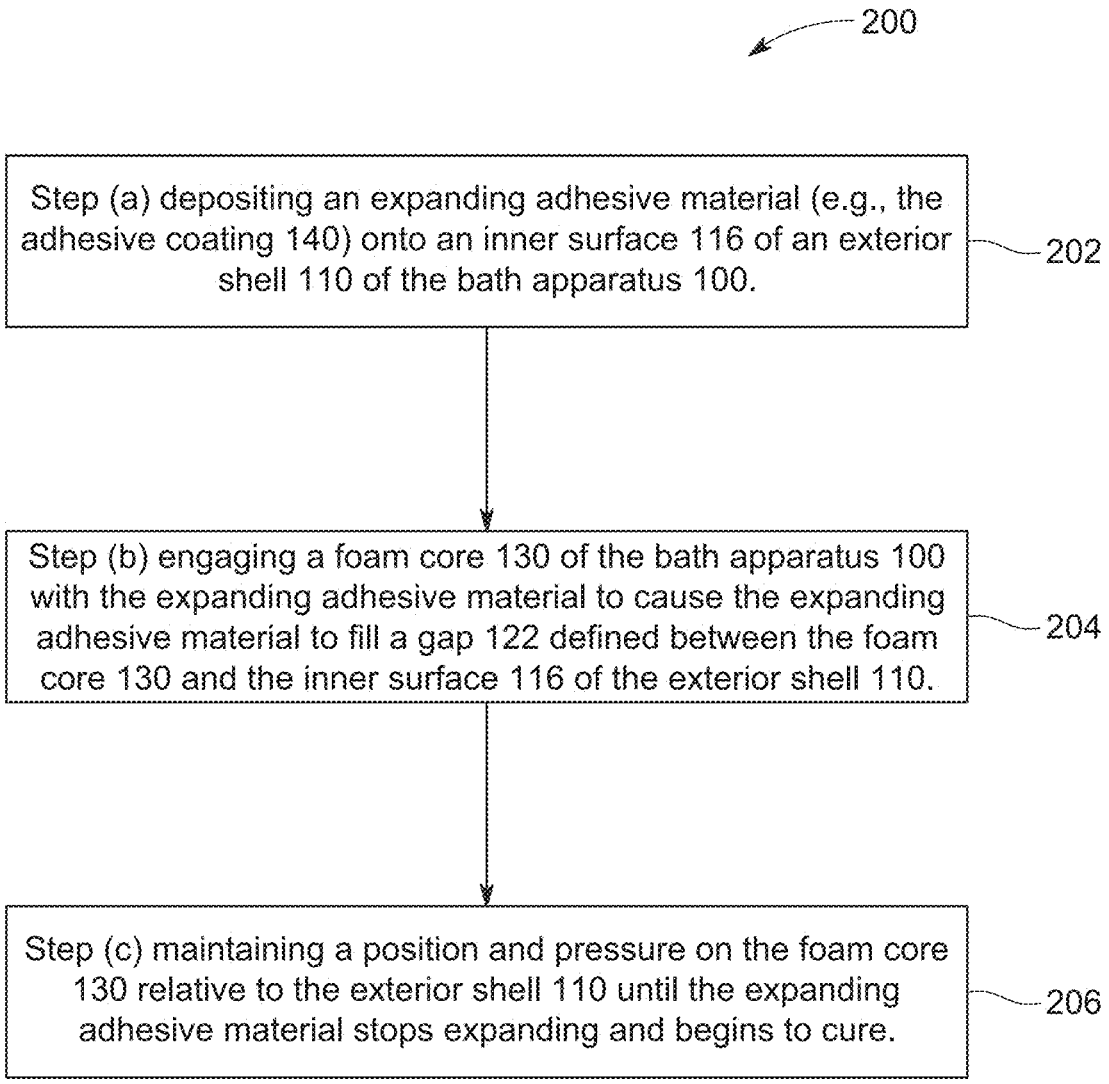
FIG. 10 is a flow diagram of a method of assembling a bath apparatus in accordance with the present disclosure.

Referring to FIG. 10, a method 200 of assembling the bath apparatus 100 is illustrated. The method 200 may include step (a) depositing 202 an expanding polyurethane material (e.g., the adhesive coating 140) onto an inner surface 116 of an exterior shell 110 of the bath apparatus 100. The method 200 may further include step (b) engaging 204 an inner core 130 of the bath apparatus 100 with the polyurethane material to cause the polyurethane material to fill a gap 122 defined between the inner core 130 and the inner surface 116 of the exterior shell 110. The method 200 may further include step (c) maintaining 206 a position and pressure on the inner core 130 relative to the exterior shell 110 until the polyurethane material stops expanding and begins to cure.

Step (a) of the method 200 may further include depositing a bead of the expanding polyurethane material to specific areas of the inner surface 116 and in specific proportions corresponding to the gap associated with the specific area. The gap 122 may generally be smaller than the bead diameter.

The method 200 may further include positioning the inner core 130 relative to the inner surface 116 of the exterior shell 110 such that the gap 122 is defined.

Throughout the specification and claims, the following terms take at least the meanings explicitly associated herein, unless the context dictates otherwise. The meanings identified below do not necessarily limit the terms, but merely provide illustrative examples for the terms. The meaning of "a," "an," and "the" may include plural references, and the meaning of "in" may include "in" and "on." The phrase "in one embodiment," as used herein does not necessarily refer to the same embodiment, although it may.

Although embodiments of the present invention have been described in detail, it will be understood by those skilled in the art that various modifications can be made therein without departing from the spirit and scope of the invention as set forth in the appended claims.

This written description uses examples to disclose the invention and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

It will be understood that the particular embodiments described herein are shown by way of illustration and not as limitations of the invention. The principal features of this invention may be employed in various embodiments without departing from the scope of the invention. Those of ordinary skill in the art will recognize numerous equivalents to the specific procedures described herein. Such equivalents are considered to be within the scope of this invention and are covered by the claims.

All of the compositions and/or methods disclosed and claimed herein may be made and/or executed without undue experimentation in light of the present disclosure. While the compositions and methods of this invention have been described in terms of the embodiments included herein, it will be apparent to those of ordinary skill in the art that variations may be applied to the compositions and/or methods and in the steps or in the sequence of steps of the method described herein without departing from the concept, spirit, and scope of the invention. All such similar substitutes and modifications apparent to those skilled in the art are deemed to be within the spirit, scope, and concept of the invention as defined by the appended claims.

The previous detailed description has been provided for the purposes of illustration and description. Thus, although there have been described particular embodiments of a new and useful invention, it is not intended that such references be construed as limitations upon the scope of this disclosure except as set forth in the following claims.

What is claimed is:

1. A method of assembling a bath apparatus, the method comprising the steps of:

(a) depositing an expanding adhesive material onto an inner surface of an exterior shell of the bath apparatus;

(b) engaging a foam core of the bath apparatus with the expanding adhesive material to cause the expanding adhesive material to fill a gap defined between the foam core and the inner surface of the exterior shell; and (c) maintaining a position and pressure on the foam core relative to the exterior shell until the expanding adhesive material stops expanding and begins to cure.

2. The method of claim 1, wherein:

the foam core includes a core drain opening aligned with a shell drain opening of the exterior shell.

3. The method of claim 2, further comprising:

positioning a drain reinforcement member between the exterior shell and the foam core, the drain reinforcement member including an upper flange, a reinforcement opening defined through the upper flange, and a downward extending rim surrounding the reinforcement opening.

4. The method of claim 3, wherein:

the upper flange engages the inner surface of the exterior shell surrounding the shell drain opening, and the downward extending rim is received within the core drain opening.

5. The method of claim 3, further comprising:

engaging a downward protrusion of the exterior shell with a channel formed in the upper flange of the drain reinforcement member.

6. The method of claim 3, wherein:

the drain reinforcement member further includes a plurality of triangular reinforcements positioned between the upper flange and the downward extending rim.

7. The method of claim 6, wherein:

the plurality of triangular reinforcements are positioned between the reinforcement opening and the downward extending rim.

8. The method of claim 3, wherein:

a diameter of the upper flange is greater than twice a diameter of the reinforcement opening.

9. The method of claim 1, wherein:

engaging the foam core with the expanding adhesive material defines a gap between the foam core and the inner surface of the exterior shell, the gap including a plurality of gap distances defined perpendicular to the foam core.

10. The method of claim 9, wherein:

the expanding adhesive material fills the gap.

11. The method of claim 9, wherein:

each of the plurality of gap distances is less than or equal to a predetermined maximum gap distance.

12. The method of claim 11, wherein:

the predetermined maximum gap distance is less than or equal to one inch.

13. The method of claim 9, wherein:

the gap is greater than zero, and the gap decreases near one or more edges of the exterior shell configured to engage a support surface when installed.

14. The method of claim 9, wherein:

the gap is substantially similar over a majority of the inner surface of the exterior shell.

15. The method of claim 1, wherein:

the expanding adhesive material forms a continuous layer between the foam core and the inner surface of the exterior shell after curing.

16. The method of claim 1, wherein:

the expanding adhesive material comprises a polyurethane-based material.

17. The method of claim 16, wherein:

the polyurethane-based material includes an expanding agent and a hardener.

18. The method of claim 1, wherein:

the exterior shell has a thickness of 0.08 inch.

19. The method of claim 1, wherein:

the exterior shell has a thickness less than or equal to 0.1 inch.

20. The method of claim 1, wherein:

the foam core comprises a solid foam material having a density between 2.0 pounds per cubic foot and 2.8 pounds per cubic foot, such that a deflection of the exterior shell after curing is less than or equal to 0.05 inch.

* * * * *